United States Patent [19]

Pichl

[11] Patent Number: 4,600,395

[45] Date of Patent: Jul. 15, 1986

[54] BOAT DRIVE

[75] Inventor: Heinz Pichl, Upsala, Sweden

[73] Assignee: AB Volvo Penta, Gothenburg, Sweden

[21] Appl. No.: 44,053

[22] Filed: May 31, 1979

[51] Int. Cl.[4] ..... B63H 21/26

[52] U.S. Cl. ..... 440/61; 440/89; 440/112

[58] Field of Search ..... 440/49, 52, 53, 57, 440/61, 63, 88, 89, 111, 112, 55–56, 58, 62, 64–65; 64/7, 14, 27 NM, 30 R, 30 E

[56] References Cited

U.S. PATENT DOCUMENTS

| | | | |
|---|---|---|---|
| 2,772,649 | 12/1956 | Gensheimer et al. | 440/52 |
| 2,908,243 | 10/1959 | Erickson | 440/61 |
| 3,183,880 | 5/1965 | Shimanckas | 440/52 |
| 3,293,883 | 12/1966 | Boschi et al. | 64/14 |
| 3,893,407 | 7/1975 | Hurst | 440/57 |
| 3,952,687 | 4/1976 | Brownlie | 440/57 |

FOREIGN PATENT DOCUMENTS

| | | | |
|---|---|---|---|
| 1907615 | 6/1970 | Fed. Rep. of Germany | 440/64 |

*Primary Examiner*—Trygve M. Blix
*Assistant Examiner*—Jesus D. Sotelo
*Attorney, Agent, or Firm*—Arthur G. Yeager

[57] ABSTRACT

A boat drive has a leg formed by three portions, the upper portion passing through the transom opening and may be preassembled with the inboard engine. Lower leg portions are readily detachable from the upper. The leg has a forward and an aft engine cooling water intake ports. A water pump is supplied water via a channel connected to the aft port which joins a forward port, and another channel lead to the water pump. When the leg is tilted up, aft port is out of water but the channels form a water lock where they join to prevent sucking of air through aft port. The leg includes exhaust passageway through propeller hub, and check valve element moves to close exhaust passageway during reverse. Another exhaust outlet is near or above water level and the exhaust passage leading thereto is closed by a water lock which receives water from a water inlet port in the trim tab. A torsion intermediate shaft drives the propeller through a rubber damping and overload-preventing coupling. The coupling is splined separable between separable leg portions. Gear shift mechanism parts disposed below the gears on the propeller shaft are accessible by a removable end closure member which carries a skeg. Gear shift mechanism includes an upright rod connected for up and down movement through a spring-loaded lost motion connection to an actuating lever. A cam member at the lower rod end cooperates with a transmission dog clutch. A spring-loaded detent retains the rod in a neutral position until moved by the lever into drive positions.

48 Claims, 15 Drawing Figures

FIG. 1A
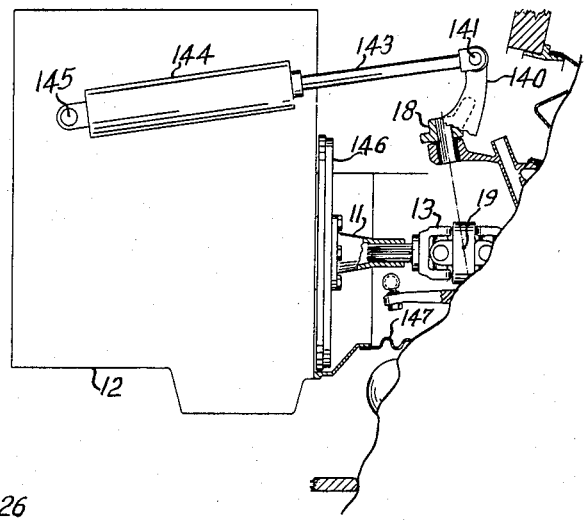
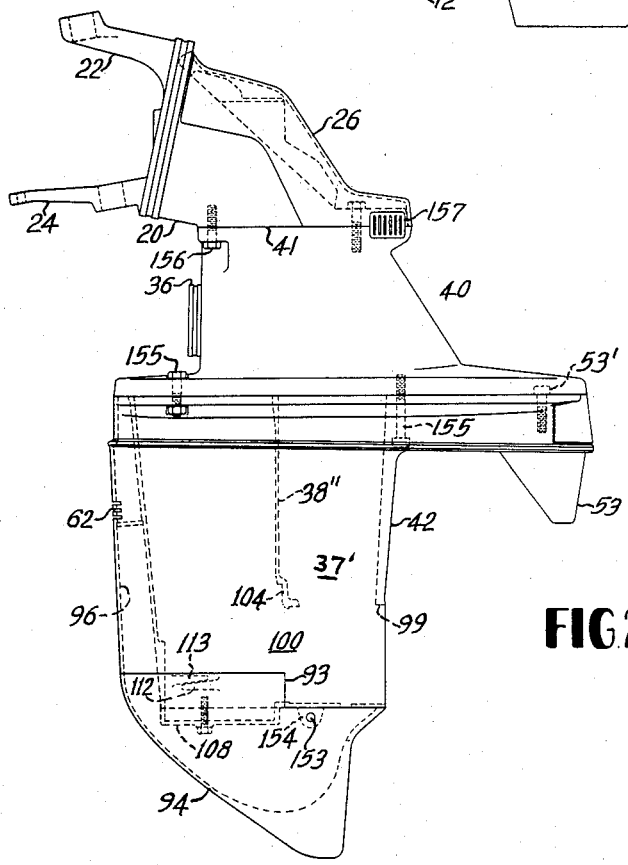
FIG. 2
FIG. 3
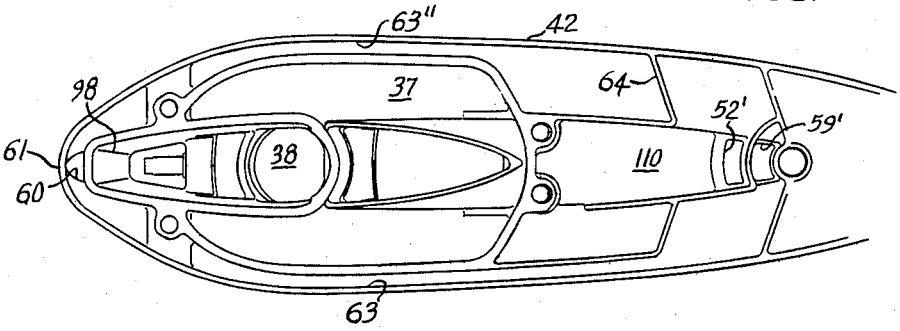

BOAT DRIVE

BACKGROUND OF THE INVENTION

The invention relates to marine propulsion devices of the type which include an outboard drive leg carrying a propeller on the lower end portion. While certain features of the invention are also applicable to drives commonly known as outboards, the invention particularly relates to inboard-outboard drive units.

SUMMARY OF INVENTION

The invention provides an inboard-outboard drive in which the outboard leg includes a forwardly extending upper neck portion which extends through a diaphragm which closes a transom opening around the neck portion. A gimbal ring member inwardly of the boat, forwardly of the diaphragm, is mounted on horizontal axis pivot bearings fixed to the boat, while the forward end of the neck is pivotally supported on a gimbal member for steering movement of the leg about a generally upright axis normal to and intersecting the horizontal tilt axis. Since the drive unit is mounted to the transom on horizontal axis bearings, and since the trim-tilt cylinder connects to the engine rather than to a portion of the transom spaced vertically from the tilt axis, there is no vertical torque applied by the leg to the transom from propeller reaction during driving of the boat. The leg housing comprises main upper, intermediate and lower pressure die cast sections, preferably of aluminum alloy, which bolt together each to the next. The upper section is so proportioned that it may pass through the opening provided in the transom of the boat to facilitate installation.

All of the steering, trimming, and tilting, mechanisms are located for ready accessibility forward of the diaphragm. The gear shifting mechanism is adapted for remote control through, for example, a coaxial cable from the steering station in the boat which connects to a lever readily accessible from within the boat through the open front of the neck portion and includes rod and linkage components which extend into the neck and down through the leg housing to a camming member adjacent the transmission in the lower end portion of the housing.

All of the trim, tilt, steering and gear shifting elements are so arranged that they may be pre-assembled, along with the upper leg housing portion, to the engine for installation with the engine and upper housing portion at one time, requiring no separate connections to the boat transom beyond the mounting of the gimbal to the transom.

The bottom of the lower leg housing section is open to permit the positioning of casting plugs for forming interior chambers and for supporting other plugs during the pressure die casting, and further to provide in the completed leg upward access into the gear transmission chamber portion of this lower section. The open bottom is closed by a curved cover plate bolted in place. The plate carries an integral skeg, and a new plate may be easily substituted if the skeg becomes damaged.

The forward or leading edge of underwater housing portions of outboard drive legs are subject to damage when hitting large underwater objects at high speed. Along the leading edge of the lower or underwater portion of the leg according to this invention a water chamber is formed, and a water inlet port comprising several small openings opens into this chamber. Should an object puncture through the leading edge, there would be no interference with a normal cooling water flow. Below the water chamber a damage chamber is provided which does not open through the leading edge but which is open downwardly and rearwardly into the bottom of a rearwardly disposed exhaust gas chamber and thence outwardly through the hollow propeller shaft into the propeller slip stream. Should the damage chamber be accidentally ruptured, permitting water to enter, such water would merely drain out through the propeller hub.

A trim tab element is bolted to the anticavitation plate rearwardly of the propeller, and it is provided with two water inlet ports into which water is forced by the propeller when the boat is being driven forwardly. These ports respectively communicate with two channels, a cooling water channel and a channel to a water trap in the exhaust system. The cooling water channel extends horizontally, when the leg is in normal untilted drive position, along one side of the leg and opens forwardly into the cooling water chamber. A second cooling water channel connects both with the cooling water chamber and with the forward end of the first channel and extends from this connection horizontally and rearwardly along the other side of the leg and, at a rearward portion of the leg, turns into an upwardly and forwardly inclined portion in the upper housing section to supply water to a water pump located between bevel gears which connect the horizontal power input shaft to the top of the upright intermediate shaft. The pump impeller is in line with and driven by an extension of one of these shafts, being shown as drivingly connected to the intermediate shaft. Water from the pump is supplied to the engine water jacket.

The novel features which are believed to be characteristic of this invention are set forth with particularity in the appended claims. The invention itself, however, both as to it organization and method of operation, together with further objects and advantages thereof, may best be understood by reference to the following description taken in connection with the accompanying drawings, in which:

FIG. 1A is a similar fragmental view showing on a reduced scale, the portions of the engine and cylinder omitted from FIG. 1;

FIG. 2 is a side elevational view on a reduced scale of of the outboard leg housing of the unit of FIG. 1;

FIG. 3 is a top plan view, on an enlarged scale, of the underwater housing portion of the housing of FIG. 2;

Figure 1:
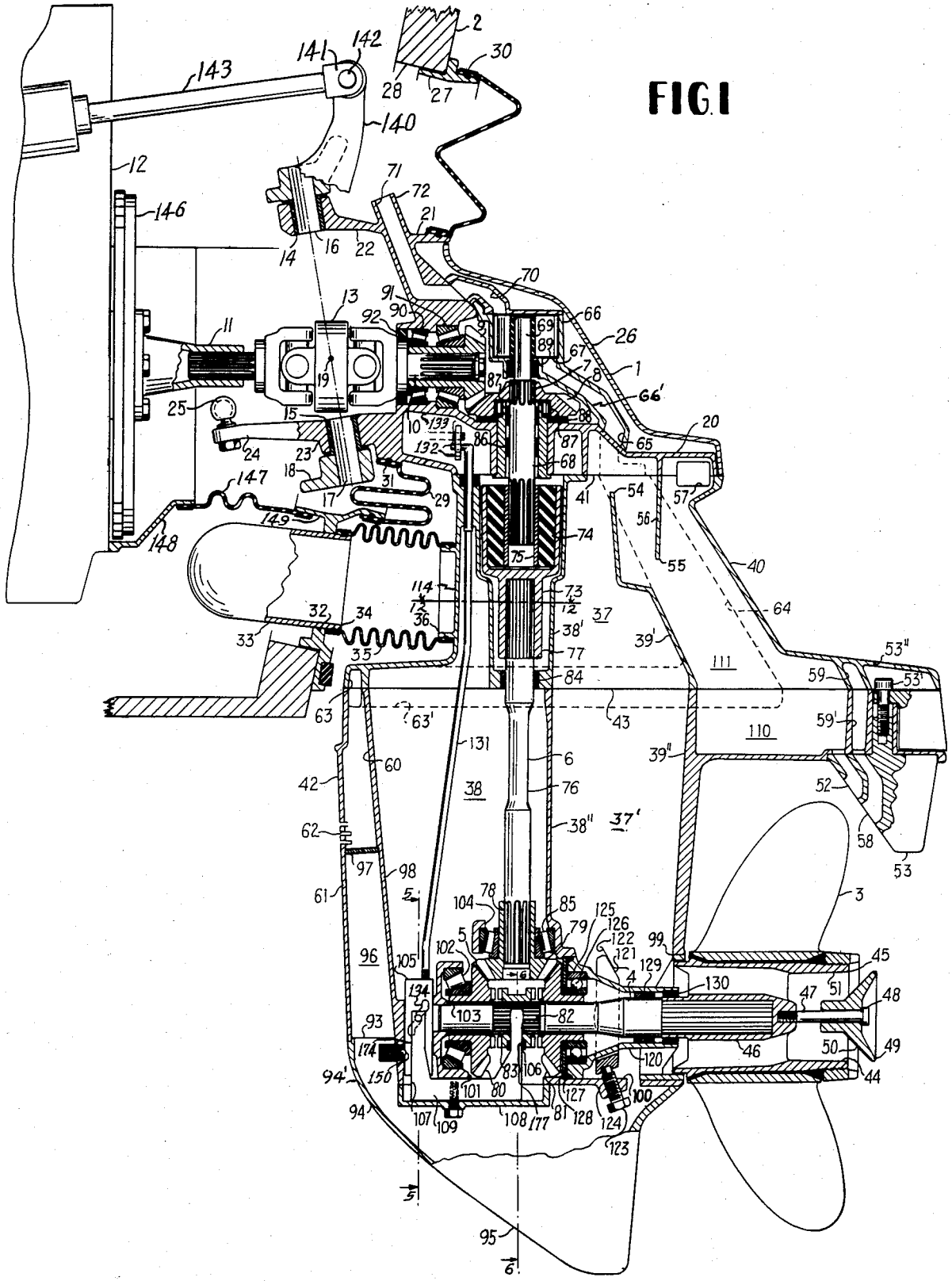
FIG. 1 is a sectional side view of an inboard-outboard drive unit according to the invention, portions of the engine and tilt-trim cylinder being omitted.
Figure 5:
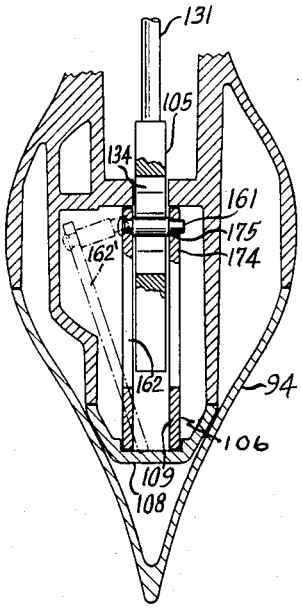
Figure 6:
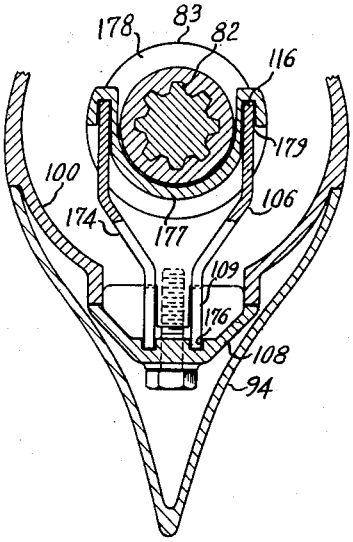
Figure 7:
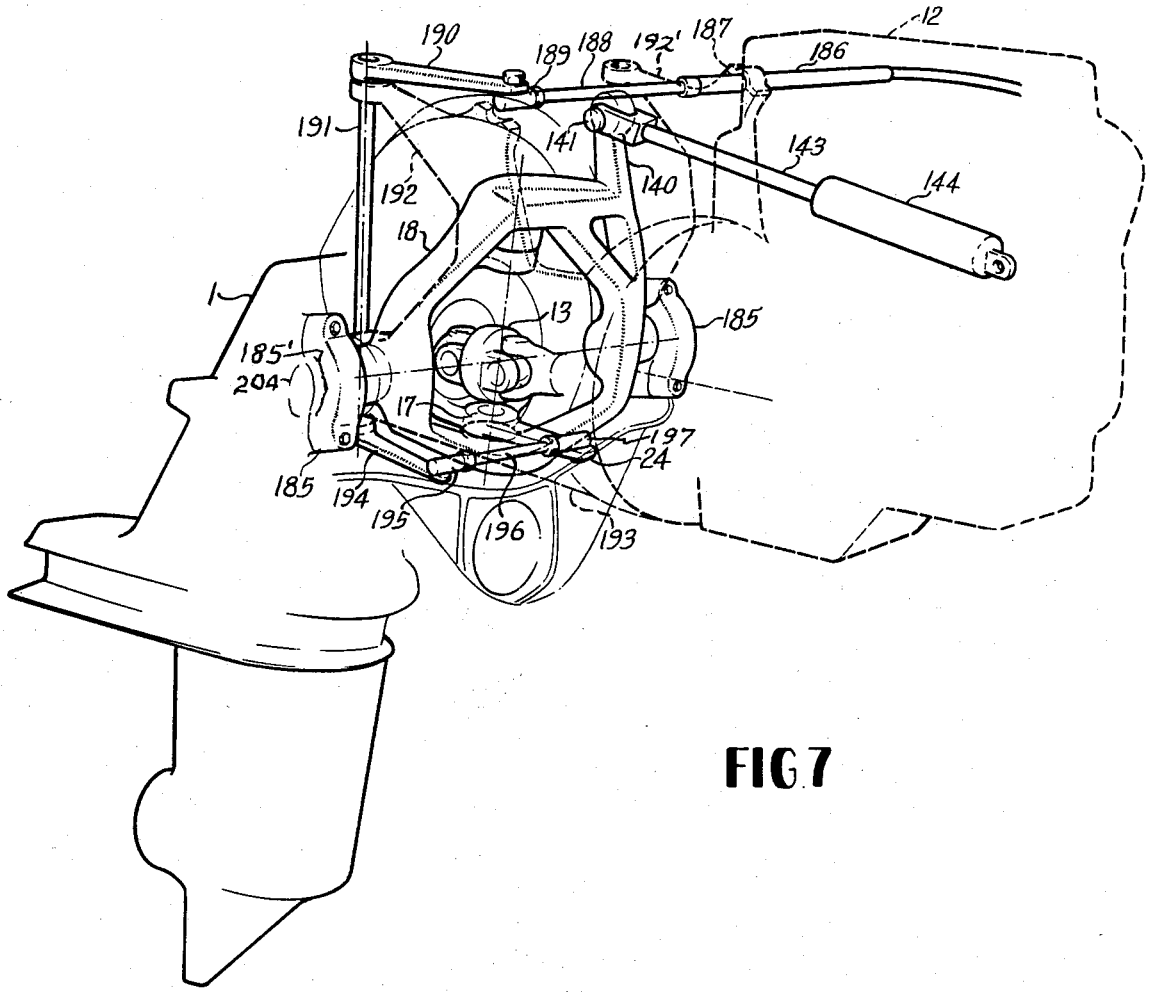
Figure 8:
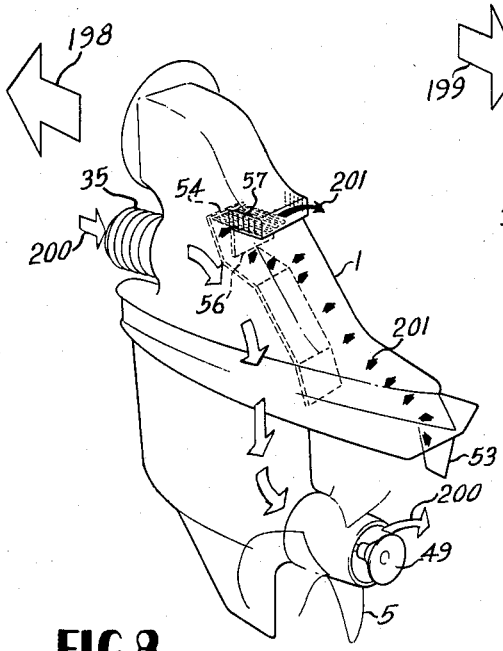
Figure 9:
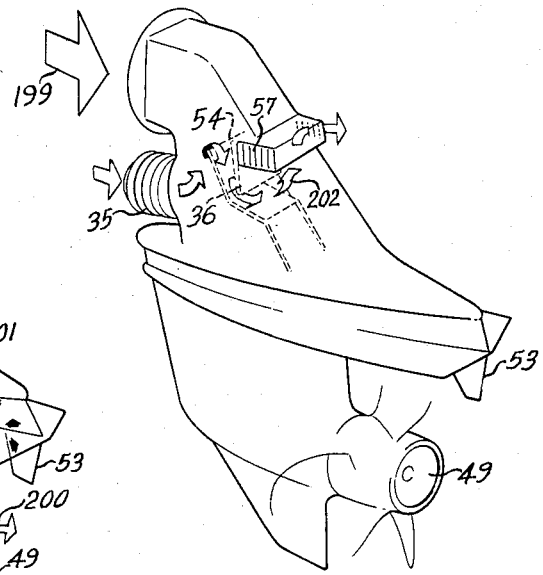
Figure 10:
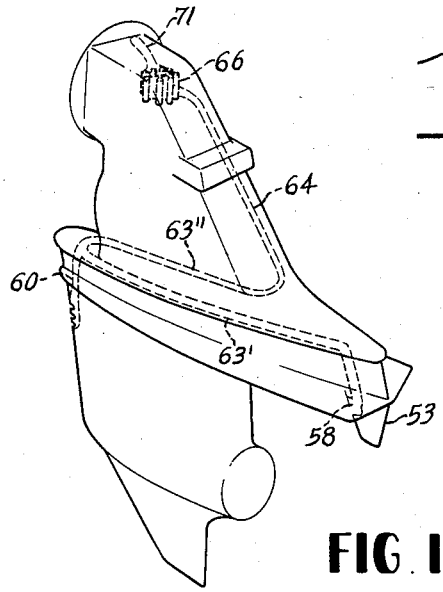
Figure 11:
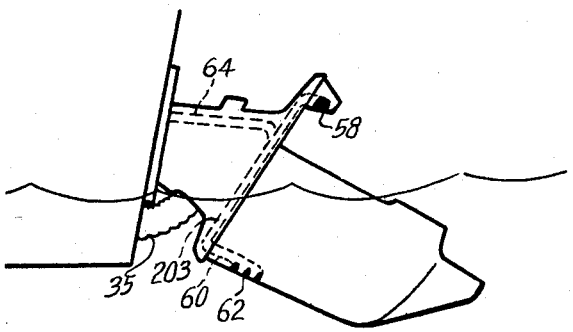
Figure 12:
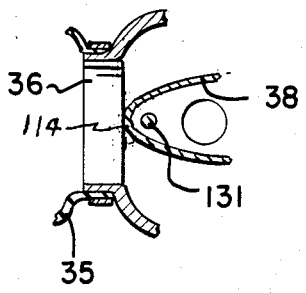
Figure 13:
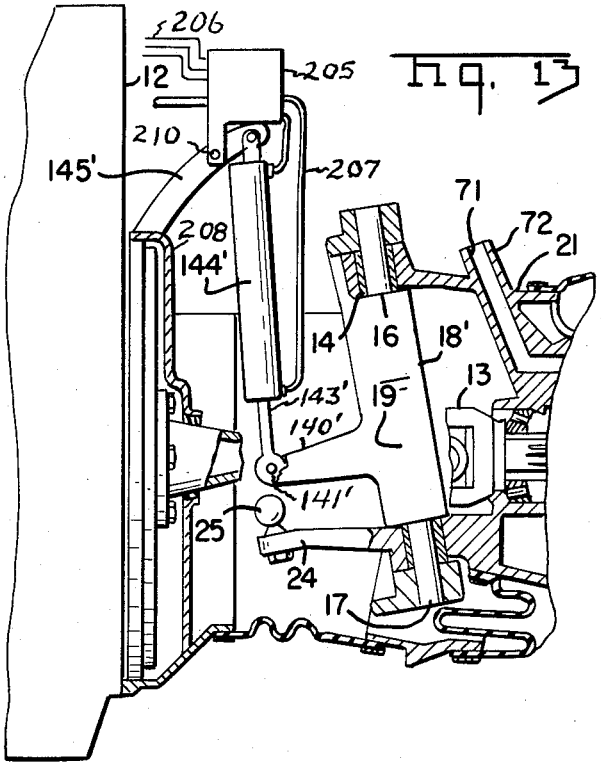
Figure 14:
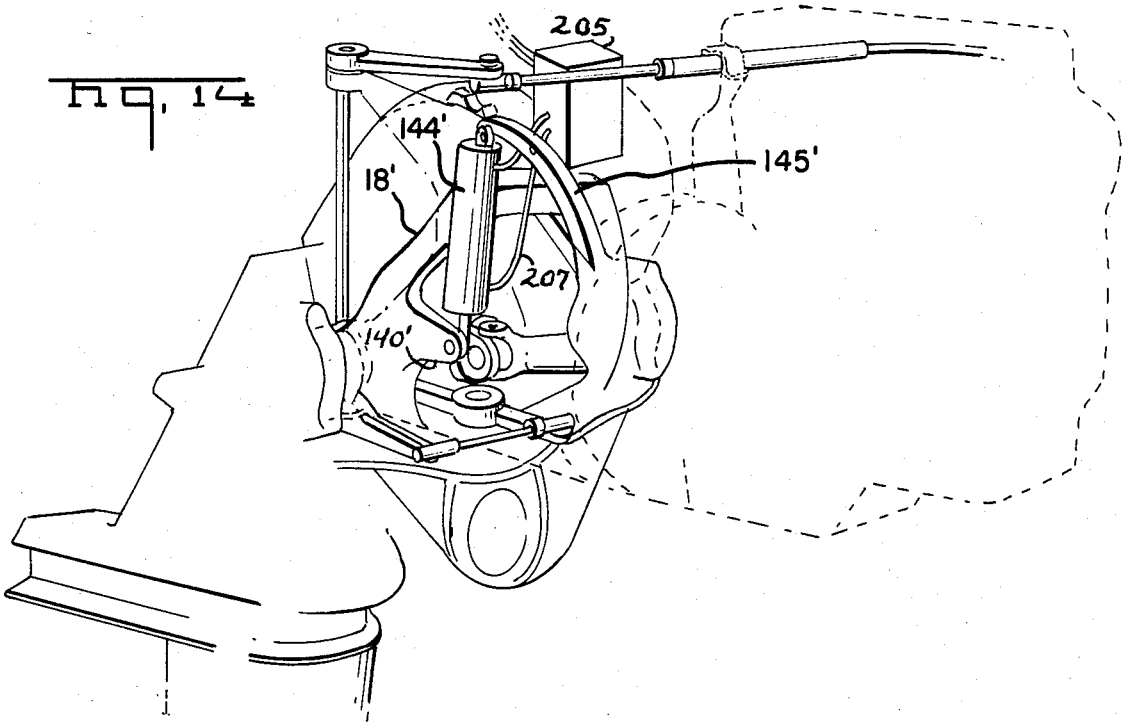

FIGS. 5 and 6 are sectional views on enlarged scales taken along lines 5—5 and 6—6, respectively, of FIG. 1;

FIG. 7 is a diagrammatic representation of the gimbal mounting, tilt-trim, and steering systems for the unit of FIG. 1;

FIGS. 8 and 9 are diagrammatic representations of the outboard leg showing the exhaust gas paths during forward and reverse propulsion, respectively;

FIGS. 10 and 11 are diagrammatic representations showing the cooling water passages as oriented with the outboard leg in upright and tilted positions, respectively;

FIG. 12 is a sectional view taken along line 12—12 of FIG. 1;

FIG. 13 is a side elevational view showing a broken-away portion of an inboard outboard drive unit according to a modified embodiment of the invention; and FIG. 14 is a diagrammatic representation of the gimbal mounting, trim-tilt, and steering systems for the unit according to the modified embodiment of FIG. 13.

Referring now to the drawings, as seen in FIG. 1, the outboard leg 1 of an inboard-outboard drive for a boat having a transom 2 carries a propeller 3 driven by a propeller shaft 4 which receives power through a forward-neutral-reverse gear transmission 5 from an upright intermediate torsion shaft assembly 6 of which the upper end 7 is coupled through bevel gear wheels 8 and 9 to an input shaft 10. Shaft 10 is driven by the drive shaft 11 of an inboard engine, represented at 12, through a double universal joint assembly 13.

The leg is mounted by bearings 14 and 15 on upright journals 16 and 17 of a gimbal ring 18, the ring being tiltable about a horizontal transverse axis intersecting, or substantially intersecting, the upright axis at a working center indicated at 19. The upper housing portion 20 of the leg includes a forwardly extending neck portion 21 which is provided with arms 22 and 23 to mount the bearings 14 and 15, and the lower arm 23 is continued forwardly of bearing 15 into a steering arm portion 24 provided with a connection for a conventional remote steering control linkage in the form of knuckle 25.

A frame 27 is adapted to be affixed by screws or the like (not shown) to the transom around transom aperture 28, and a pleated, flexible, water-impervious membrane, a diaphragm or septum 29 is peripherally sealed to the transom completely around the aperture by attachment thereof to the frame 27 by a clamping band 30. The membrane has an opening through which the neck portion 21 extends, with edge portions of the membrane bordering such opening sealed tightly around the neck by a clamping band 31. An opening 32 is further provided through frame member 27 to pass engine exhaust pipe 33 from the interior of the boat to an outlet end 34 disposed outboard and aft or rearwardly of the frame member. The outlet end is connected through a flexible corrugated bellows tube 35 to a flanged opening 36 of the outboard housing 1. The tube elongates and bends upon tilting of the outboard leg. A passage, showing of which is omitted for clarity from FIG. 1, conducts engine exhaust gasses laterally around and to port of drive shaft assembly 6 into an exhaust chamber 37 in the leg which is defined between a forward wall comprising upper and lower sections 38′ and 38″ disposed adjacently rearwardly of the drive shaft assembly 6, a rear wall, comprising upper section 39′ and lower section 39″, and the side walls of the housing. Wall sections 38′ and 38″ separate and prevent entry of exhaust gas into the intermediate shaft chamber 38 from exhaust gas chamber 37.

The outboard leg housing comprises three principal pressure die cast members, upper housing portion 20, which meets intermediate housing portion 40 along a plane 41, and a lower, underwater housing portion 42 which meets the intermediate portion along plane 43. During normal forward propulsion, the exhaust gasses, which may, if desired, entrain engine cooling water, pass downwardly in chamber 37 and out through the open bottom thereof into the hollow outer propeller mounting sleeve 44 to be finally exhausted through the circular opening defined by the rear end lip portion 45 of the outer sleeve. Details of an appropriate propeller and of the means for mounting the propeller on the propeller shaft are described and claimed in U.S. Pat. No. 3,952,686 assigned to the assignee hereof. The inner sleeve portion 46 of the propeller mounting member carries, however according to the present invention a rearwardly extending post or pin 47 screwed into the rearward end portion of the inner sleeve and coaxial therewith, the pin terminating rearwardly in an enlarged knob or head 48. A generally conical check valve member 49 is freely slideably entrained on pin 47, being retained thereon by knob 48. The valve member takes the aftward open position shown in FIG. 1 during forward propulsion, but it will slide forwardly during reverse operation into a closed position in which its conical sealing surface 50 is seated against lip portion 45, which acts as a valve seat, thereby to close off exhaust passage 51 through the hollow hub and thus to prevent the entrance of water into chamber 37 and thence into the engine exhaust pipe 33. A normally water locked exhaust relief passage is provided, rear wall 39′ being arranged to retain behind it, during forward propulsion, water forced into a port 52, which is provided in trim tab 53 and which opens forwardly toward propeller 3, up to the level of the top 54 of wall 39′ and above the level of the lower end 55 of trap wall 56. Excess water spills over into chamber 37, and water may also pass outwardly into the air through auxiliary exhaust outlet openings 57 which are arranged one on each side of the housing rearwardly of wall 56. During idle or reverse operation, the water level in trap chamber 111 drops below the lower end 55 of wall 56 and the auxilliary or relief exhaust gas path is thus opened over the upper edge 54 of wall 39′ and under the lower edge 55 of wall 56 to the above-water exhaust openings 57.

The trim tab 53 is held in a desired adjustable setting by a cap screw 53′ to which access is provided through small opening 53″ in housing portion 40.

Trim tab 53 is provided, in addition to port 52, with an engine cooling water entrance port 58 oriented to receive water from the propeller slip stream. Port 58 connects with a passage 59 which extends horizontally, when the leg is in normal upright position, forwardly along the port side of the leg and which opens into water inlet chamber 60 disposed inwardly along the leading edge 61 of the leg. Water intake screen 62 in the leading edge 61 is provided to permit the entrance of cooling water directly into chamber 60, particularly when the leg is kicked up and when, consequently, port 58 is out of water, or when for any other reason, such as clogging of the port 58, insufficient water is supplied forwardly through passage 59.

From chamber 60 a further water passage 63″, best seen in FIG. 3, extends rearwardly along the starboard side of the leg. Spacedly rearwardly of the chamber 38, passage 63″ turns upwardly into an upwardly and forwardly inclined water passage section 64, shown in broken lines in FIG. 1. Passage section 64, in turn communicates with a pump inlet passage 65 of pump housing 66. This housing contains a rotary pump impeller 67 in the angular space between bevel gear wheels 8 and 9 and coaxially aligned with the shaft carrying one of the gears. As shown in FIG. 1, impeller 67 is axially aligned with upper shaft portion 68 of the drive shaft assembly 6. Shaft 68 comprises a reduced upwardly extending portion 69 on which the impeller is mounted. The impeller is driven whenever the engine is operating, even though the transmission is in neutral, and delivers water into pump outlet passageway 70 formed in the pump housing 66, and this passageway communicates with a passage 71 formed in the upper housing portion 20 of the leg. A nipple-like projection 72 from such housing portion permits ready connection of a suitable hose (not shown) to supply water to the engine.

The bevel gear wheels 8 and 9 are located generally under the water conduits 65 and 70 and under the pump housing 66 and are accordingly surrounded by what is, in effect, a water jacket, which serves both to cool the gear wheels and to dampen the noise of the gear wheels. The position of the impeller projecting upwardly from the upper housing 20 permits ready access for inspection or replacement by removal of the cosmetic cover 26 and the pump housing 66. The disposition of the pump housing and impeller and the ease with which it may be assembled in the leg and removed therefrom, also facilitate the assembling of the drive leg.

The intermediate shaft assembly 6 includes a cup-shaped metal coupling member 73 containing a rubber or the like bushing 74, and the bushing surrounds a central metal sleeve 75. The bushing is adhered to member 73 and to sleeve 75, either by frictional contact or by bonding, to transmit somewhat more than normal maximum drive torque without slippage. Shaft 68 is splined in sleeve 75. A torsion shaft portion 76 of the intermediate shaft assembly extends upwardly into lower socket portion 77 of the coupling and is splinedly connected thereto.

The torsion shaft portion 76 is designed to twist up to about 540 degrees between its ends upon excessive or unusual loads, and, if the load exceeds the amount corresponding to 540 degrees of twist, the rubber bushing 74 is ruptured, such as by sliding with respect to sleeve 75 or cup member 73 or by otherwise yielding therebetween, thus to prevent damage to other parts, such as breakage of shafts, gears, or the propeller. While such bushing rupture requires subsequent replacement of the bushing and, possibly, any element to which it is bonded, it is possible to operate at low loads with the ruptured bushing, since low loads may still be transmitted through the coupling, permitting, for example, a low speed return to shore. Protective rubber bushings having this cabability have been previously known in boat drives. It will be apparent that the rubber bushing has, furthermore, in normal operation, a torsional damping or cushioning function in the drive train, and that it will take up shock rotational loads, as well as slight lateral misalignments between the shafts 68 and 76. Since the shaft portions are splined to the respective metal elements of the coupling they may be readily slipped in and out thereof, permitting the upper and intermediate leg housing portions to be easily taken apart from each other or joined along the plane 41. The lower end portion 78 of shaft 76 is splinedly connected to bevel drive gear wheel 79 of transmission 5, and this gear wheel meshes with spaced bevel gear wheels 80 and 81 which are disposed on and are freely rotatable with respect to propeller shaft 4. The propeller shaft portion 82 which lies between the spaced gear wheels 80 and 81 is splined and slideably carries a dog clutch member 83 for rotation therewith. The clutch member when moved toward one of the gear wheels 80, 81 locks the propeller shaft for driving by the selected gear wheel in the forward propulsion direction, and when moved toward the other gear wheel, locks the shaft for driving in the opposide direction for reverse propulsion.

A sleeve bearing 84 is provided for the torsion shaft seated in intermediate housing portion 40 and located immediately below coupling member 73, and a tapered roller thrust bearing 85 seated in lower housing portion 42 is provided for bevel gear wheel 79, thereby additionally providing lower end support for the shaft. The upper shaft 68 of the intermediate drive shaft assembly 6 is provided with sleeve bearings 86 and is further supported by roller bearing 87 located internally of gear wheel 8 and by a thrust washer 88 disposed under this gear wheel. Each of these bearings is seated in the upper housing structure 20.

The upper end extension pump shaft portion 69 of shaft 68 is provided with a water seal 89 seated in gear housing portion 66' which also serves as a part of pump housing 66. Tapered roller bearings 90 and 91 seated in upper housing portion 20 support input shaft 10 and bevel gear 9, and a dirt and oil seal 92 is provided around shaft 10 between the bearings 90, 91 and the universal joints 13 to shield the bearings against the entrance of water or other foreign matter into the housing and to prevent oil or grease in the leg housing from leaking into the boat. The lower housing portion 42 is pressure die cast and is formed with an open bottom as indicated by line 93 at which detachable lower end closure or cover member 94 meets the housing portion 42. Cover member 94 is cast to include an integral skeg portion 95 and is so bolted to the housing portion 42 (by bolts not shown) that it may be detached for access to the transmission, for example, or for replacement if the skeg is damaged. The forward end portion 94' of the cover member 94 comprises an impact portion of the lower portion of the leading edge of the leg. This portion and the skeg being the most subject to damage, the arrangement desirably permits such damaged parts to be readily replaced.

In forming lower housing portion 42, an upwardly tapered die casting plug is inserted upwardly through opening 93 to form the water inlet chamber 60 and the contiguous damage chamber 96, these chambers being later isolated by fixing a small septum or wall element 97 in the completed casting. If the striking of an object causes a rupture of leading edge 61, thus permitting water to enter into chamber 96 or into chamber 60, shaft chamber 38 will remain protected by the separating wall 98. Such rupture will, moreover, not interfere with the supply of cooling water.

Another tapered die casting plug is oriented downwardly to form chamber 38, and this plug, together with a generally cylindrical plug which is directed horizontally inwardly, form the circular exhaust opening 99 and the generally cylindrical cavity 100 for the transmission 5, and also including inward wedging projections 113 for retaining a forward cup portion 101 wedged in place in the housing 42. The cup portion receives and mounts forwardly disposed tapered roller rotational and thrust bearing 102 for the gear wheel 80. The propeller shaft 4 is rotatably supported in part by sleeve bearing 103 in gear wheel 80. A detail internal casting plug is locked to the upper portion of the transmission-cavity-forming portion of this horizontal casting plug to extend upwardly between walls 38" and 39" to form a clearance cavity for gear wheel 79 and a cup portion 104 integral with housing portion 42 for mounting bearing 85. A portion of the upwardly inserted casting plug for forming chamber 96 and a meeting portion of the downwardly inserted plug for forming chamber 38 may also cooperatively form space for a shift-actuating head 105 and for the forwardly and rearwardly movable legs 106 which engage with dog clutch member 83 for accomplishing the gear shifting functions of the clutch member. The casting plug for forming chamber 96 may also include a portion forming a bottom opening 107 into the transmission cavity 100. The last mentioned opening is later closed by a channelized cap 108 in which the body portions 109 of leg members 106 are slideably carried. The downwardly inserted die casting plugs for forming chambers 37 and 38 in housing portion 42 also form the lower portions 59' and 63' of water passages 59 and 63, and the casting plug for forming the lower portion 37' of the exhaust chamber in portion 42 of the housing additionally forms the lower portion 110 of the water trap chamber 111, which communicates with water inlet port 52.

After casting is completed, the downwardly introduced die casting plugs are withdrawn upwardly, the horizontal die casing plug is pulled horizontally outwardly, freeing the detail die casting plug, which formed the cup portion 104 and the exhaust opening 99, for dropping out through the exhaust and propeller shaft opening or through the open bottom 93. The die casting plug for chamber 96 is also withdrawn through the bottom opening.

The provision of a cooling water inlet and conduit or passageway to the pump which are separate from the inlet opening and passageway to the exhaust water trap permits the ready manufacture of the housing sections by pressure die casting with removable tapered casting plugs. Moreoever, while backing down, the propeller action rapidly drains the exhaust gas water trap, and such action is not interferred with by the provision of the intermediate inlet opening 62 for the cooling water system through which water is still supplied for the water pump even when the propeller action is tending to drain water from the trim tab cooling water opening or port 58.

The bearings, gear wheels and dog clutch elements of the transmission are readily introduced through the open rear end of cavity 100 and positioned therein, additional access to this cavity being afforded through the bottom opening 107.

A generally conical end closure cap member 120 is inserted horizontally into the cavity 100, together with a retaining ring member 121 which seats against lateral wedge shaped projections 122 formed by the aforementioned detail plug integrally with and internally of the housing portion 42 and extending laterally inwardly into cavity 37. Cap screw 123 is forwardly inclined and threadedly engaged in wall 124 which partially defines cavity 100. Tightening of screw 123 against ring member 121 urges member 120 forwardly against the outer race 125 of ball bearing 126, of which the inner race mounts bevel gear wheel 81.

Shaft 4 freely rotatably extends through bevel gear wheel 81. Member 120, in turn, urges outer race 125 against a spacer in the form of washer 127 against a circular lip 128 extending inwardly from the circular cavity-defining wall 124. It will be understood that wall section 38'' is integral with wall 124 and that both are integral with and constitute internal portions of lower housing member 42. Suitable sealing means are provided to prevent the entrance of water or exhaust gas peripherally around member 120 to or past lip 128 or washer 127 into the transmission chamber or chamber 38.

Member 120 carries an internal sleeve bearing 129 for shaft 4 and water seal rings 130 isolating the space inwardly of member 120 from entry of water or exhaust gas along the shaft.

Figure 4:
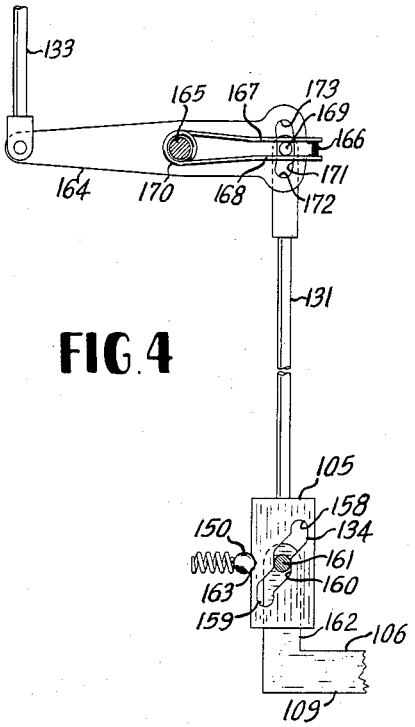
FIG. 4 is a diagrammatic representation of portions of the gear shifting control mechanism of the unit according to FIG. 1.

Gear shifting is accomplished by vertical movements of control rod or link 131 which carries the head 105 at its lower end and is raised and lowered by a lost-motion connection 132 at its upper end to the remote actuating mechanism generally indicated at 133. Head 105 comprises a generally "S" shaped cam slot 134 which is followed by the leg member 106 as best seen in FIGS. 4, 5 and 6 later described. It will be seen that a spring-loaded detent 150 projects from the housing to engage head 105 tending to retain the head in its intermediate position corresponding to neutral setting of the transmission.

As seen in FIGS. 1 and 1A, the gimbal member 18 is provided with an integral upstanding arm portion 140 which is pivotally connected at 141 spacedly above the horizontal tilt axis 19 of the gimbal to the retractable rod 143 of hydraulic trim and tilt cylinder 144, the cylinder being pivotally attached on a horizontal axis at 145 to the boat engine 12. The cylinder and rod, accordingly, require no attachment to the boat itself and are positioned in a protected position internally of the boat and not exposed externally to the water in which the boat operates. The cylinder and rod may, moreover, be preassembled with the engine, gimbal and upper housing portion 20.

The cylinder is arranged to control the rod by hydraulic power means to maintain the drive leg in adjustable trim position, and to power tilt the leg when desired. The hydraulic system further provides for rapid tilt up of the leg with retraction of the rod into the cylinder when excessive force is externally applied to the leg, as when striking a submerged object during forward movement of the boat. Various hydraulic trim-tilt systems having these capabilities are known in the art.

The flywheel 146 of the engine 12 is shown as carrying output or engine drive shaft 11, and this shaft is, in turn, connected through a splined joint to universal joint assembly 13.

An apron or skirt 147, which may be of rubber-like sheet material reinforced by embedded fabric or cords similar to that used for membrane 29, underlies the shaft 11 and extends up along the sides of the flywheel housing or end bell 148 to which it is suitably attached along its forward edge. It is similarly attached along its rearward edge to portion 149 of frame 27. The apron serves to prevent grease from reaching the bilge of the boat and as a protection to the flywheel, shaft 11 and universal joint assembly. Moreover, the apron 147 extends sufficiently upwardly alongside the shaft 11 and universal joints that, should diaphragm or membrane 29 be ruptured or develop a leak from any cause, water which might enter would be held in the skirt and would not flow into the bilge, whereby the skirt provides protection against sinking. The skirt thus serves as a water-receiving damage control trough extending above the external water level.

Further details of the gimbal, steering, and trim and tilt arrangements are later described in connection with FIG. 7.

Referring now to FIG. 2, showing the several pressure die cast members of the housing, with interior portions shown in broken lines, it will be seen that two internal lateral wedging projection, of which projection 113 is shown in this view, are formed integrally with lower housing portion 42 for engagement with ears of tabs, such as ear 112, which extend laterally outwardly from bearing cup member 101. Skeg and closure member 94 is attachable by bolts or cap screws (not shown) through openings, such as opening 153, the bolts or screws being threaded into bosses, such as boss 154, formed integrally with portion 42. With closure member 94 and cap member 108 removed, opening 107 provides sufficient upward access into the transmission cavity 100 and chamber 38 to insert bearing 85 and gear wheel 79, as well as shaft 76, if desired, into the positions shown in FIG. 1 and similarly to insert the outer race of bearing 102 into the cup member 101. The end closure cap 120 and its retaining ring member 121, bearing 125 and gear wheel 81 are insertable through the circular exhaust and propeller shaft opening 99 formed in the cast housing portion 42.

Assembly of the transmission is accomplished by inserting the drive shaft gear wheel 79 and its bearing 85 into place, preferably through the open bottom of the leg housing, i.e. with cover member 94 removed, and by positioning the outer race element of tapered roller bearing 102 in the cup 101. The gear wheel 80 carrying the inner race and rollers is inserted into the housing through the open lower end 107 and brought into rough engagement with gear wheel 79. By tilting gear wheel 80 about the points to engagement of its teeth with the teeth of gear wheel 79, the bearing rollers may be slipped into position in the outer race. It will be noted that the axis of a roller remote from the area of tooth engagement between gear wheels 79 and 80 is approximately perpendicular to the direction from such gear wheel engagement to such roller. In other words, a line constructed perpendicularly to the lowermost part of the outer race, the part which is furthest from the gear wheel 79, would pass substantially through the teeth engaged between the gear wheels 79 and 80. It will be apparent that a lesser angle between the outer race and the rotational axis of the bearing than the angle described will not permit installation of gear wheel 80 in the manner outlined above. While a greater angle would tend to facilitate such installation, a greater angle would also tend to make the bearing less efficient as a rotational bearing. Once gear wheel 80 is in place, dog clutch member 83 and gear wheel 81 may be mannually positioned and shaft 4 inserted therein through the opening 99.

The inner race of bearing 102 is formed with caging lips for retaining the rollers thereon and a suitable roller cage member (not shown) is provided, whereby the gear wheel 80, inner race and the rollers are preassembled before introduction through opening 107.

It will be seen from FIG. 12 that the exhaust gas passing through tube 35 into the leg housing divides around the wall 114 which directs the gas along the sides of the housing into the exhaust chamber 37.

FIG. 2 shows bolts or cap screws 155, 156 for connecting lower housing portion 42 to intermediate housing portion 40 and for connecting the latter to the upper housing portion 20. The auxiliary exhaust outlet is fitted with a cosmetic grill 157. The grill 157 comprises a plurality of vanes which are inclined forwardly, so that, when backing down, if the grill is submerged slightly below the water level, water tends to flow past the grill rather than to enter into the exhaust water trap which is being drained through port 52. The cosmetic and protective cover member 26 is seen to extend across the top and somewhat downwardly along the sides of the upper housing portion 20.

FIG. 3 is a top view of the lower housing portion 42 and shows the cooling water passage portion 59′, which connects with the trim tab inlet port, arranged to provide water forwardly along port-side passage section 63′ to a juncture with water inlet chamber 60 immediately adjacent the leading edge 61. The water inlet passage continues along starboard-side passage portion 63″ to a juncture with the upward section of the passage.

The lower portion 110 of the water trap chamber includes opening 52′ for communication with the trim tab port 52 previously described whereby the trap chamber may receive water from the tab port 52 during forward propulsion and may drain during propulsion in reverse.

It will thus be apparent that blocking of either one or the other of the water inlet openings 62 or 52 or tilting of the leg, such as while operating in shallow water, will not interrupt the supply of water to the engine, and that accidental rupture of the leg along its leading edge will not interrupt such supply of water, and, so long as any such rupture does not break partition or wall 98, the transmission will not be subjected to water damage.

In that the cooling water passageway 63 surrounds the exhaust chamber 37, and the normally full water trap passageway and chamber 110, 111 lies along the exhaust chamber, each provides substantial cooling of the leg housing and of the exhaust gases. The water intake port 52 for the water trap is separate from the engine cooling water system and is disposed rearwardly of the propeller and in the slip stream to receive a relatively large flow of water during forward propulsion.

A remote control shift arrangement is selected which includes a control element 133 typically constituting the end of the core of a coaxial cable leading from the drive unit to a steering station forward in the boat.

FIG. 4 shows details of the gear shifting mechanism. Rod 131 carries head 105 at its lower end and is arranged for upward and downward movement. Head 105 includes an "S" shaped cam slot 134 having an upper end portion 158, a lower end portion 159 and an intermediate portion 160, and the cam slot is followed by a cam-follower in the form of pin 161. Pin 161 is carried between two upstanding arms of the legs 106, arm 162 being seen in this view. The head 105 is normally retained in the centered or neutral position, as shown in this view, by a spring loaded detent 150 which seats in a notch 163 formed in head 105. With the head in neutral position with pin 161 in portion 160 of the slot, raising of rod 131 will cause pin 161 to traverse the slot into the lower end slot portion 159, moving the legs 106 forwardly, whereas lowering the head will cause the pin to traverse the slot into the upper end portion 158, moving the legs 106 rearwardly from the neutral position. The forward position of the legs may correspond to the forward drive position of clutch element 83, with gear wheel 80 drivingly coupled to the shaft 4 through splines 82, while the rearward leg position, with gear wheel 81 coupled to drive the shaft through clutch element 83 and splines 82, will then correspond to reverse or rearward drive, although it will be understood that the drive directions will depend upon the direction in which intermediate drive shaft 6 is driven by the engine and whether the propeller has a right or left hand pitch. In any case, the intermediate position of the legs, with pin 161 in the intermediate portion 160 of slot 134 and detent 150 seated in notch 163, corresponds to the centering of clutch element 83 between the gear wheels whereby the transmission will be in neutral.

The rod 131 is shifted upwardly and downwardly by means of a lever element 164 which is pivotal on a pivot pin fixedly attached to the housing portion 20. The lever 164 is rotated about this pivot pin 165 through a small arc by means of a remote control link 133 attached to suitable cables or the like leading to the remote control station in the boat. A stop element 166 extends from lever 164 in a direction toward the viewer in FIG. 4 and a double leaf spring, comprising legs 167 and 168, is arranged to cage a pin 169 between the leaves. The spring may comprise, as shown, a spring wire element having a loop 170 connecting the leaves or legs 167 and 168, the loop being coiled about the pin 165 for support. The legs normally exert spring force against the opposite sides of stop 166. The arrangement is such that rotation of lever 164 through a small arc about pin 165 in a direction to raise the stop element 166 will cause the stop element in turn to raise leaf 167 while leaf 168 will separate from element 166 and will remain in engagement with pin 169 until leaf 168 imposes sufficient force against pin 169 to cause rod 131 to be raised. It will be noted that the pin 169 is disposed in a lost motion slot 171 provided in the lever 164, and upon such raising of the stop element 166 by rotation of lever 164, if the spring 168 imposes insufficient force against pin 169 to move the head 105 against the restraint of the detent, the pin 169 will progress to the lower end 172 of the slot 171 and will then be forced upwardly by direct engagement with the lever, thereby to overcome the restraint of the detent. When the head 105 moves out of central position detent 150 becomes disengaged from notch 163 and no longer imposes a restraining force on the head, and the head 105 will then be pulled rapidly upwardly, in a snap action, by leaf 168 until this leaf again contacts stop 166 or until pin 161 reaches the end of the portion 159 of the cam slot. Remote control linkages, which may include coaxial cables and which are generally represented by element 133, frequently have substantial play between the control station forward in the boat and the inboard-outboard unit. Such play is compensated for by the springs 167, 168 and slot 171 since it is only necessary to move the lever 164 in the upward direction sufficiently to cause the head to be raised and the pin 161 to be seated in the lower end 159 of the slot 134 to cause the transmission to be in, for example, forward gear. Thereafter, relaxation of the force applied by the remote control cables (or other remote control linkage) will cause no further motion of the head but the lever 164 will seek a position in which both leaves 167 and 168 of the spring are engaged against stop 166 and in which pin 169 is aligned between pin 165 and stop 166, that is to say, midway of the lost motion slot 171.

While it normally will be unnecessary to do so, it will be understood that additional notches, similar to notch 163, may be provide along the head 105, one spaced above and one below the notch 163, one corresponding to the location of the head when the pin 161 is disposed in the lower end portion 159 of the cam slot and the other corresponding to the position of the head when pin 161 is disposed in the upper end portion 158 of the slot.

To dislodge pin 161 from the lower end portion 159 of slot 134, the operation of the control is reversed, that is to say, the lever 164 is moved in the direction to lower stop portion 166 until the head, either by the force of spring leaf 167 or by engagement of pin 169 with the upper end 173 of the lost motion slot 171, is sufficient to cause the head to move until detent 150 again seats in notch 163. Thereafter, further operation of the control will cause the head to be further lowered until the pin 151 lodges in the upper end 158 of the cam slot, thereby to shift to reverse drive.

It will be understood that the mechanism as shown in FIG. 4 is diagrammatic, and specifically, the lever 164 and pin 165 and the associated elements are shown for clarity as rotated 90 degrees about the axis of rod 131, it being preferred that lever 164 be oriented perpendicularly to the legs 106 and that pin 165 extend parallel to legs 106.

The details of the gear shifting mechanism components which are adjacent the transmission, and the method of assembly thereof, are best understood with reference to FIGS. 5 and 6. The pin 161 at one end is fixed to one of the leg portions between which head 105 is disposed. The pin a shown is fixed to leg portion 162, and it is formed with a shoulder 175 adjacent the end not so fastened. The end of the pin beyond the shoulder is arranged to be fittingly inserted into an opening in leg portion 174. The closure cap 108 is provided with grooves, such as groove 176, in which the body portions 109 of the sliding dog clutch actuating members 106 are slidably disposed. A yoke member 177 partially encircles the dog clutch member 83, being disposed in the central groove 178 of the clutch member.

With the cap member 108 and closure member 94 removed, the rod 131 carrying head 105 may be manually inserted downwardly to a position between the legs 162 and 174 while leg 162 is tilted outwardly away from leg 174, as shown in broken lines at 162' in FIG. 5. With the head 105 held in position by manipulation of rod 131, the leg 162 is rocked by hand through the bottom opening from its inclined position 162' so as to cause the pin 161 which is fixed thereto to pass through cam slot 134 and to engage at its free end in leg 174, the parts then being in the assembled positions shown in solid lines in FIG. 5. In the meantime, referring to FIG. 6, as the dog clutch actuating leg members are so brought into parallel relationship, the rearward upper leg portions, are engaged in sockets, such as socket 179, in the yoke member 177, and, when so engaged, and when cap member 108 has been raised into position to engage the body portions 109 of these leg members in their respective grooves 176 in the cap member, the legs are retained thereafter in their appropriate parallel positions and with the pin 161 spanning between them and engaged in each.

In that the torsion damper bushing 74 is arranged in the intermediate shaft 6, 68 there is no need to provide damping between the propeller and propeller shaft. The bushing 74 is simple to install and permits easy assembly and disassembly of the drive unit itself and facilitates installation in the boat. Upper housing section 20 is proportioned to fit through the transom opening and may, accordingly, be pre-assembled to the engine before installation, being slipped through the transom opening as the engine is being placed in the boat. The connection of the intermediate housing portion 40 to the upper portion 20 merely requires alignment of the lower socket portion 77 coupling member 73 with the shaft 76, or alignment of the bushing sleeve 75 with the shaft 68, depending upon which of these shafts is carrying the coupling member, and the slipping into place of the parts of the gear shifting control connection 132, and, finally, the bolting together of the portions 20 and 40.

The attachment and detachment of the lower housing and intermediate housing portions is similarly facile. Gear wheel 79 of the transmission being in place, the lower splined end 78 of shaft 76 slides freely in or out of the socket therein. The gear shifting head 105 is readily attached to or detached from the leg member 106 when cap 108 is removed as described in connection with FIG. 5. To attach the lower housing portion 42, accordingly, the shaft 76 is properly aligned, the head 105 is aligned between the separated legs, with leg 162 in its broken line 162' position, and the housing portions are brought and bolted together. The legs 106 are thereafter positioned to engage pin 161 in the cam slot 134 and cap 108 is replaced.

The gimbal leg mounting, trim-tilt, and typical steering arrangements are further shown in FIG. 7. The gimbal 18 is supported on the boat for tilting on the horizontal axis (indicated at 19 in FIG. 1) by means of pillow bearings 185. The trim-tilt rod 143 connects through pin 141 to the upstanding arm portion 140 of the gimbal spacedly above the horizontal tilt axis, whereby retractions of rod 143 into cylinder 144 cause upward tilting of the leg 1. A coaxial steering cable 186 of known type is anchored to the engine by a fixed clamp 187, and the movable core 188 of the cable is connected by a knuckle joint 189 to a steering control arm 190. Arm 190 is fixed to an upright transfer shaft 191 rotatably supported by a bracket 192, the bracket 192 being unitary with clamp 187 and attached to engine 12 through rigid arm portions 193. Lower steering control arm 194 is also fixed to shaft 191 to swing with arm 190, and the lower arm is coupled by knuckle joint 195 and link 196 to knuckle joint 197, of which the knob 25 (previously described) is a part. The swinging of arm 190 about the axis of shaft 191 in response to operation of a remote steering wheel as transmitted through cable 196 thus causes steering arm portion 24 of the leg to swing laterally to thereby swing the leg about the steering axis.

The engine 12 is mounted and supported by means of its unitary and rigid bracket 192. Bracket 192 includes the port portion 192', on which the clamp 187 is formed. The gimbal member 18 includes integral horizontal trunnions projecting from each side, such as starboard trunnion 204, which pass rotatably through split cap bearings portions of bracket 192 and thus support the engine. The pillow block bearings 185 are provided with rubber sleeves 185' to reduce transmission of vibrations to the boat. The engine is provided additionally with forwardly disposed preferably resilient supporting means appropriate to the boat.

FIG. 8 shows schematically the exhaust path and the movement of water into and through the water trap during forward propulsion in the direction of arrow 198 and may be compared with FIG. 9 representing conditions during reverse propulsion in the direction of arrow 199. In FIG. 8, the exhaust gases entering the leg through tube 35, as indicated by arrows 200, pass downwardly through the exhaust chamber in the leg 1, through the hollow hub of propeller 5 and out into the propeller slip stream, the valve member 49 being in its rearward position. The propeller forces water, as shown by arrows 201, in through the forwardly oriented water trap inlet port 52 of the trim tab 53 and upwardly in the previously described water trap chamber to a level above the lower end of trap wall 56. The water may then spill over lip 54 into the exhaust gas chamber, thence to pass outwardly through the propeller hub with the exhaust gas, and may also flow out through the auxiliary exhaust outlet opening ports 57.

When the drive is operated in reverse, water is no longer forced upwardly into the water trap chamber but any water therein drains therefrom through the trim tab port 52. The exhaust gases are now free to pass from the exhaust gas chamber, over lip 54, as shown by arrows 202, under the trap wall 56 and thence outwardly through ports 57 into the air. The check valve member 49 is, during reverse operation, in its forward position, closing off the outlet from the propeller hub thereby to prevent the forcing of water up into the exhaust gas chamber 37 in the leg. When the transmission is in neutral with the boat at rest, the water trap chamber will drain in the same manner as described, although somewhat more slowly since the rearward movement and propeller reactions during reverse drive tend to reduce the pressure at the trim tab port 52, providing low backpressure exhaust through ports 57 even though valve member 49 may not be fully closed. Thus the pressure of the water at the propeller hub does not build up excessive pressure against exhaust gases.

FIG. 10 shows in perspective the cooling water passages in the leg. From the intake port 58, passage 63' extends forwardly and generally horizontally along the port side of the leg to an intersection with water inlet chamber 60 immediately behind the leading edge of the leg. The passage continues from such intersection in a portion 63'' extending generally horizontally rearwardly along the starboard side of the leg and turning upwardly toward the rear of the leg into upwardly and forwardly extending passage section 64 to the water pump 66. From the pump, the water passage 71 extends forwardly for attachment to a hose (not shown) through which the engine is supplied.

The cooling water supply is such that when, as shown in FIG. 11, the leg 1 is tilted, and the trim tab cooling water intake port 58 is out of water, the supply of cooling water remains uninterrupted. The forward portions of passage sections 63' and 63'' form a water lock generally indicated at 203 connected to intake water chamber 60 into which water enters through intake screen 62. The screen and lock 203 remain underwater. Water drawn by the pump from passage 64 is supplied into the water lock through the screen 62 whereby air from port 58 is prevented from passing beyond lock 203. During reverse propulsion, while the propeller may tend to cause water to pass outwardly through port 58, engine cooling water enters through intake screen or slots 62.

A modified trim-tilt arrangement is shown in FIGS. 13 and 14 according to which the gimbal ring 18' includes a unitary generally horizontal forwardly extending arm 140' disposed to starboard of the double universal joint, a supporting arm 145' fixed to the engine and extending upwardly and rearwardly therefrom, and a hydraulic tilting and trimming cylinder 144' pivotally connected to arm 145' at its upper end and having a downwardly extensible piston rod 143' pivotally connected at 141' to arm 145'. An electrically operated hydraulic pump and electrically controlled valve assembly 205, which may be of a known type, may be conveniently mounted on arm 145' by bolt 210 and supplied with power and controlled by power supply and remote control means represented by wires 206, the assembly being connected to the cylinder by suitable hydraulic lines, such as line 207.

While only one cylinder 144' disposed to starboard is shown in FIGS. 13 and 14, it will be apparent that such cylinder, and arms 145' and 140', may be duplicated on the port side if desired in order to balance the forces on the gimbal trunnions and on the engine, with the hydraulic connections to the port cylinder being in parallel with those to the starboard cylinder.

Relocation and reorientation of the trim-tilt cylinder according to this modified embodiment requires less intrusion into the engine space and, when the leg strikes an underwater object and is forced to tilt, the piston rod is moved outwardly of, rather than inwardly of the cylinder, thus desirably decreasing rather than increasing the hydraulic pressure in the cylinder. The location of the pump and valve assembly 205 on the arm 145' desirably permits short hydraulic lines 207 to the cylinder or cylinders.

A further modification according to FIG. 13 is in the provision of a protective septum wall 208 sealed around its outer periphery to the end bell 146 and flywheel housing 148 of the engine 12, and having a central opening provided with a shaft seal collar 209 engaged around the output shaft 11 of the engine. This septum wall is disposed closely adjacent the engine and is generally vertical thereby to be out of the way of the gimbal ring when the leg is tilted.

It will be understood that the elements shown in FIGS. 13 and 14 which are not described specifically are in accord with FIGS. 1 and 7 as those figures are described.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An inboard-outboard drive for a boat having an apertured transom, said drive comprising a propeller, a propeller leg including a generally upright portion carrying said propeller disposed outboard of said transom and said leg further including an upper neck portion extending inwardly through the aperture in said transom, an engine fixedly mounted in said boat, a flexible watertight sealing member surrounding, extending outwardly from and sealed to said neck portion and sealed to said transom around said aperture, a universal mount for said leg comprising a gimbal member defining perpendicular horizontal and upright axes intersecting at the working center of said mount, said gimbal member being disposed inboard of said sealing member and supportingly connected to said neck portion for pivoting of said propeller leg on one of said axes, said mount further comprising means connected to the boat pivotally supporting said gimbal for pivoting on the other of said axes, drive means connecting said engine to said propeller, said drive means including a universal joint extending through said axes and having a working center substantially coincident with said working center of said universal mount, and means disposed inwardly of said sealing member connected between said engine and said neck portion for tilting said leg on said horizontal axis.

2. The combination according to claim 1 wherein said one axis is such upright axis and said other axis is such horizontal axis, and said tilting means is connected to said neck portion through said gimbal member.

3. The combination according to claim 2 wherein said neck portion comprises an integral arm portion extending forwardly of said one axis and terminating forwardly in a steering control connection portion.

4. In combination, in an inboard-outboard drive for a boat having an apertured transom, a propeller leg comprising an outboard propeller-carrying portion and an upper neck portion extending inwardly through the aperture in said transom, universal mounting means connecting said neck to said boat having a working center in or adjacent said transom aperture mounting said neck portion for tilting and steering movement in said aperture, and an inboard engine fixed in said boat having an end bell, drive means extending from said end bell into said neck portion, a flexible watertight skirt member underlying said drive means having a first end portion sealed to said end bell under said drive means and upwardly and outwardly along each side of said end bell and an opposite end portion sealed to said transom under said aperture and upwardly and outwardly along each side of said aperture, said skirt being continuous between said sealed end portions to form a trough under said drive means, said trough being proportioned to extend upwardly along both sides of said drive means to above the normal water level of the boat thereby to receive and retain water which may enter said transom aperture.

5. The combination according to claim 4 wherein a flexible waterproof membrane surrounds and is sealed to said neck member and extends outwardly therefrom and is sealed outwardly to said transom around said aperture thereof thereby normally to close said aperture against the entrance of water into said trough.

6. In an inboard-outboard drive leg for a boat, said leg comprising an upper end portion having a generally horizontal input shaft therein and an intermediate portion joining said upper end portion and having a generally vertical intermediate shaft therein which is perpendicular to said input shaft, bevel gears coupling said shafts in said upper end portion, said shafts being disposed along axes which intersect in the angular space between said gears, a cooling water pump comprising a rotatable impeller disposed in said space and coaxial with one of said shafts, said one shaft having an extension portion extending beyond the bevel gear thereon and into said space and drivingly mounting said impeller.

7. The combination according to claim 6 wherein a gear housing wall is disposed between said impeller and said gears, said wall being provided with a water sealed aperture through which said extension portion extends, said water pump comprising housing means extending outwardly around said impeller, and said gear housing wall constituting an inner part of said water pump housing means thereby to be cooled by the cooling water therein.

8. The combination according to claim 7 wherein said housing means is detachably attached to said gear housing wall and seals thereto outwardly around said impeller.

9. The combination according to claim 7 wherein said leg comprises a housing of which said wall constitutes a portion, and wherein said combination further comprises a water pump cover member extending outwardly around said impeller, and means detachably attaching said cover member to said gear housing wall, said means being outwardly exposed thereby to afford access to said impeller exteriorly of said housing.

10. In an inboard-outboard drive, an outboard propeller leg housing, an upright intermediate shaft journalled in said housing and having an upper end portion, a first gear wheel on said upper end portion, an input shaft journalled in said housing disposed at an angle of ninety degrees to said intermediate shaft and having a rearward end portion, a second gear wheel on said rearward end portion meshed with said first gear wheel, said housing comprising a gear housing wall portion adjacently above said gear wheels, one of said shaft end portions having an extension thereof extending beyond the gear wheel thereon and passing through said wall portion, and a water pump comprising an impeller mounted on said extension outwardly of said wall portion.

11. The combination according to claim 10 in which a cover member is disposed outwardly around said impeller and has edges engaged with said wall portion thereby defining a pump chamber of which said wall portion comprises the inner wall.

12. The combination according to claim 11 in which said one of said shaft end portions is said upper end portion of said intermediate shaft.

13. The combination according to claim 10 in which said one of said shaft end portions is the end portion of said intermediate shaft.

14. In an inboard-outboard drive unit for a boat comprising an inboard engine, an outboard leg and a gimbal member carrying said leg on a generally upright axis and having horizontally disposed oppositely arranged coaxial journal elements, first bearing means on said journal elements mounted to the boat for supporting said gimbal and second bearing means on said journal elements supportingly attached to said engine.

15. The combination according to claim 14 wherein said boat includes a rear transom and wherein the axis of said journal elements is disposed forwardly of the rearward surface of said transom.

16. The combination according to claim 14 wherein said gimbal member has portions extending above and below said horizontal axis, said combination further comprising an extensible and retractable tilting cylinder means connected between said engine and one of said portions of said gimbal member.

17. A tiltable outboard drive leg for a boat, comprising a housing carrying a propeller and having a leading edge and a rearward portion, said rearward portion including a first water inlet port disposed rearwardly of and oriented to receive water from the slip stream of said propeller when said drive leg is in normal upright drive position and being out of water when said drive leg is in upwardly tilted position, said housing being further provided with a second water inlet port along its said leading edge disposed at a level below water level when said leg is in either of said positions, means in said housing providing a water pump supply channel extending upwardly from a connection with said second water inlet port, and a channel connecting said first port to said supply channel adjacent said second port, said connecting channel extending in a rearward direction from its said connection with said second port generally horizontally when said leg is in said normal upright drive position, and said connecting channel extending from said pump supply channel and second inlet port rearwardly in an upward direction when said leg is in its said tilted position thereby to form a water lock therein.

18. The combination according to claim 17 wherein said leg comprises a water pump disposed spacedly above said connecting channel and above said second inlet port wherein said connecting channel extends along one side of said leg, and wherein said water pump supply channel comprises a first portion which, when said leg is in normal upright drive position, extends generally horizontally from said second port along the other side of said leg and a second portion disposed spacedly rearwardly of said leading edge, which said second portion extends upwardly.

19. The combination according to claim 18 wherein said housing includes an upper portion having a lower edge and a second portion disposed below said upper portion and having an upper edge conforming with said lower edge, means detachably attaching said portions with said edges in contact, said connecting channel and said first portion of said supply channel being formed in said housing along said edges and each being exposed through one of said edges when said housing portions are separated and closed by the meeting edge when said housing portions edges are in contact.

20. The combination according to claim 19 wherein a water pump is carried by said upper housing portion spacedly above its said lower edge and wherein a second portion of said pump supply channel meets said first portion at said lower edge and extends upwardly to said pump interiorly of said upper housing portion, said second portion of said channel being exposed through said lower edge when said housing portions are separated.

21. The combination according to claim 19 wherein a first intermediate shaft section is journalled in said upper housing portion and a second intermediate shaft section is journalled in said second housing portion, and wherein a spline coupling separably joins said shaft sections.

22. In a boat drive, an outboard leg having a leading edge and mounting a propeller spacedly rearwardly of said leading edge, means mounting said leg for rearward and upward tilting on a horizontal axis, said axis being disposed, when said leg is in upright drive position, generally above said leading edge and forwardly of said propeller, said leg including means having an inlet port disposed behind the propeller, said leg being provided with a second inlet port at its leading edge, each said port being disposed below the normal water line when said leg is in normal drive position and said second port being disposed a sufficient distance below said axis to be below water level when said leg is tilted to an angle at which said first port is above water level, said leg including a water pump, a channel in said leg connected at one end to said second inlet port and directed upwardly therefrom and connected at its other end to said pump, and a second channel connecting from said first port to said first channel at said second port, said second channel being directed upwardly from its said connection with said first channel when said leg is tilted sufficiently to position said first port above water level.

23. The combination according to claim 22 wherein said leg comprises a housing in which an upright intermediate shaft is journalled, said shaft has an upper end portion in said housing, a drive gear wheel on said upper end portion and driving gear wheel in mesh therewith, an input shaft journalled in said housing carrying said driving gear wheel, said housing comprising a portion constituting a gear housing disposed adjacently outwardly of said gear wheels, said pump being driven by a shaft extension of one of said shafts which passes through said portion of said housing and said portion of said housing comprising an inner pump-chamber-defining wall portion of said pump.

24. The combination according to claim 23 wherein said propeller is operable to drive in selectively forward and in reverse propulsion direction, and wherein said leg is provided with an exhaust gas passageway terminating in a rearwardly directed underwater exhaust gas outlet portion, wherein said leg is further provided with an above water auxiliary exhaust gas outlet and with a water trap interposed between said passageway and auxiliary outlet, wherein said means having an inlet port is provided with a further port disposed behind the propeller and oriented toward the propeller in the forward drive slip stream therefrom, a check valve in said underwater exhaust gas outlet portion oriented to open to pass exhaust gas rearwardly therethrough during forward propulsion and to close against the forward passage of water through said outlet portion during reverse propulsion, and a conduit in said leg connecting said further port to said water trap operative to supply water from said slip stream to said trap to isolate said passageway from said auxiliary outlet during forward propulsion and to drain said trap during reverse propulsion.

25. In an outboard drive leg for a boat, said leg comprising a housing with an internal exhaust gas passageway, a reversible hollow hub propeller mounted on said leg, means for conducting exhaust gases from said passageway through the hollow hub of said propeller in a rearward direction and outwardly underwater into the slip stream from said propeller when said propeller is driving the boat in a forward direction, a check valve in said hub oriented to open and pass gases through said hub in said rearward direction when said propeller is driving in forward direction and to close in response to the pressure of water against said valve when said propeller is driving in reverse direction.

26. The combination according to claim 25 wherein said housing is provided with an auxiliary above water exhaust relief opening communicating with said internal passageway.

27. The combination according to claim 26 wherein a water trap is provided in said housing interposed between said internal passageway and said relief opening.

28. The combination according to claim 25 wherein a trim tab is carried by said leg and has a water inlet port behind and oriented toward said propeller, said leg is further provided internally with a water trap disposed above the level of the water in which the leg operates and between said internal gas passageway and said relief opening to provide said communication, and said leg being further provided internally with a passageway connecting said port to said water trap.

29. The combination according to claim 25 wherein said leg is provided with an above-water relief opening communicating with said exhaust passageway through a water trap disposed spacedly above said propeller, wherein said leg is provided with a trim tab disposed rearwardly of said propeller, wherein said trim tab has a water intake port opening forwardly toward said propeller, and wherein said leg is provided with an upwardly extending passageway connecting said port to said water trap.

30. In an outboard drive leg for a boat comprising a housing formed with an internal exhaust gas passageway for engine exhaust gas, a hollow hub propeller carried by said leg, passageway means in said hollow hub for passing exhaust gas from said internal exhaust gas passageway rearwardly and outwardly through said hollow hub of said propeller, a check valve element, said passageway means comprising a valve seat, and means movably mounting said valve element rearwardly of said valve seat for rearward movement away from said seat to open said passageway, means for rearward passage of said gas when said propeller is not driving in reverse and for forward movement to and against said seat to close off said passageway means against the entry of water therethrough when said propeller is driving in reverse.

31. The combination according to claim 30 wherein said housing is provided with an auxiliary above water exhaust relief opening communicating with said internal passageway.

32. The combination according to claim 31 wherein a water trap is provided in said housing interposed between said internal passageway and said relief opening.

33. In an outboard drive leg comprising an internal exhaust gas passageway, and a lower unit provided with a rearwardly directed opening communicating with said passageway and a propeller shaft extending rearwardly toward said opening, a hollow sleeve mounted on said shaft in axial alignment therewith, said sleeve having an open forward end aligned with said opening and having an open rearward end portion, and a hollow hub propeller mounted exteriorly on said sleeve, the combination of a post aligned with and carried by said shaft and extending rearwardly thereof, and a circular valve member carried by and slideable along said post from a forward closed position in contact with said rearward end portion to an open position displaced rearwardly from said rearward end portion.

34. The combination according to claim 33 wherein said valve member has a frusto-conical forward face.

35. The combination according to claim 33 wherein said post terminates rearwardly in a valve-member-retaining knob portion.

36. The combination according to claim 33 wherein said valve member has a frusto-conical forward face and wherein said post terminates rearwardly in a valve-member-retaining knob portion.

37. The combination according to claim 33 wherein said leg is provided with an above-water relief opening communicating with said exhaust passageway through a water trap disposed spacedly above said propeller, wherein said leg is provided with a trim tab disposed rearwardly of said propeller, wherein said trim tab has a water intake port opening forwardly toward said propeller, and wherein said leg is provided with an upwardly extending passageway connecting said port to said water trap.

38. In an outboard drive leg for a boat comprising a housing including a first portion and a second portion disposed below and detachably secured to said first portion, an intermediate shaft assembly having an upper shaft portion carrying a gear wheel disposed in said first housing portion for driving said shaft, a journal for said upper shaft portion disposed in said first housing portion, said intermediate shaft assembly further having a lower shaft portion aligned with said upper shaft portion and carrying a propeller drive gear wheel in said second housing portion, a journal for said lower shaft portion disposed in said second housing portion, said intermediate shaft including a rubber or the like torsion damping means drivingly connected to and between said upper and lower shaft portions, readily detachable connection means between each of said shaft portions and said damping means whereby said shaft assembly is disconnected when said second housing portion is disconnected from said first housing portion, said detachable connection means including an elongated cup-like metal element having one end splinedly connected to one of said shaft portions, said damping means including a rubber or the like member disposed in and drivingly connected to said cup-like element, and said connection means including a metal sleeve element disposed in an opening in said rubber or the like member and drivingly connected thereto and splinedly connected to the other of said shaft portions, the connection between one of said elements and said rubber or the like member is defined by a frictional connection operative to slip upon the application of excessive torque between said shaft portions.

39. In an outboard drive leg for a boat comprising a housing including a first upper portion and a second portion disposed below and detachably secured to said first portion, an intermediate shaft assembly having a shaft portion carrying a gear wheel for driving said shaft assembly in said upper housing portion, a journal for said upper shaft portion in said upper housing portion, said intermediate shaft assembly further having a lower shaft portion carrying a propeller drive gear wheel in said second housing portion, a journal for said lower shaft portion in said second housing portion, said intermediate shaft assembly including a rubber or the like torsion damping member, a driving connection between said upper shaft portion and said damping member and a second driving connection between said damping member and said lower shaft portion whereby said damping member drivingly couples said shaft portions, each of said driving connections including a spline connection whereby said damping member may be readily replaced, said damping member including a cup-like metal element, a rubber or the like member disposed in and drivingly connected to said cup-like element, and a metal sleeve element disposed in an opening in said rubber or the like member and drivingly connected thereto, said spline connection including mating splines on said shaft portions and said metal elements of said damping member, the driving connection between one of said metal elements and said rubber or the like member is a frictional connection adapted to slip upon the application of excessive torque loads between said metal members.

40. In an inboard-outboard drive unit for a boat having an inboard engine and an apertured transom, the engine including an engine drive shaft extending rearwardly toward and aligned with the transom aperture and having a rearward end; said dirve unit comprising an upright propeller leg including a lower housing portion disposed aft of said transom and an upper housing portion joined thereto and partially disposed aft of said transom, said upper housing portion comprising a neck extending forwardly through said transom aperture, means pivotally mounting said neck to said boat for tilting of said leg about a generally horizontal tilt axis and for steering about a steering axis normal to and intersecting said tilt axis and establishing at such intersection a working center of said mounting means, a flexible watertight sealing element disposed rearwardly of said mounting means sealed to said neck outwardly therearound and extending outwardly from said neck and sealed to said transom around said aperture therein, said mounting means including means for fixing one of said axes with respect to the boat, a forwardly extending driven shaft disposed in said upper housing portion and having a forward end disposed rearwardly of said rearward end of said drive shaft, universal joint means drivingly connected between said forward end of said driven shaft and said rearward end of said drive shaft, said universal joint means having a working center substantially coincident with said working center of said mounting means, and means disposed forwardly of said sealing element operatively connected to said neck portion for steering and tilting said leg about said axes.

41. In an inboard-outboard drive unit for a boat having an inboard engine and an apertured transom, the engine including an engine drive shaft extending rearwardly toward and aligned with the transom aperture and having a rearward end; said drive unit comprising an upright propeller leg including a lower housing portion disposed aft of said transom and an upper housing portion joined thereto and partially disposed aft of said transom, said upper housing portion comprising a neck extending forwardly through said transom aperture, means pivotally mounting said neck to said boat for tilting of said leg about a generally horizontal tilt axis and for steering about a steering axis normal to and intersecting said tilt axis and establishing at such intersection a working center of said mounting means, a flexible watertight sealing element disposed rearwardly of said mounting means sealed to said neck outwardly therearound and extending outwardly from said neck and sealed to said transom around said aperture therein, said mounting means including means for fixing one of said axes with respect to the boat, a forwardly extending driven shaft disposed in said upper housing portion and having a forward end disposed rearwardly of said rearward end of said drive shaft, universal joint means drivingly connected between said forward end of said driven shaft and said rearward end of said drive shaft, said universal joint means having a working center substantially coincident with said working center of said mounting means, said mounting means including a mounting element supported for tilting on a laterally extending horizontal axis, and said drive unit further comprises hydraulic trimming and tilting cylinder and piston means disposed forwardly of said sealing element and having a connection with said mounting element above said horizontal axis.

42. In an inboard-outboard drive unit for a boat having an inboard engine and an apertured transom, the engine including an engine drive shaft extending rearwardly toward and aligned with the transom aperture and having a rearward end; said drive unit comprising an upright propeller leg including a lower housing portion disposed aft of said transom and an upper housing portion joined thereto and partially disposed aft of said transom, said upper housing portion comprising a neck extending forwardly through said transom aperture, means pivotally mounting said neck to said boat for tilting of said leg about a generally horizontal tilt axis and for steering about a steering axis normal to and intersecting said tilt axis and establishing at such intersection a working center of said mounting means, a flexible watertight sealing element disposed rearwardly of said mounting means sealed to said neck outwardly therearound and extending outwardly from said neck and sealed to said transom around said aperture therein, said mounting means including means for fixing one of said axes with respect to the boat, a forwardly extending driven shaft disposed rearwardly of said rearward end of said drive shaft, universal joint means drivingly connected between said forward end of said driven shaft and said rearward end of said drive shaft, said universal joint means having a working center substantially coincident with said working center of said mounting means, said mounting means including a mounting element supported for tilting on a laterally extending horizontal axis, and said drive unit further comprises hydraulic trimming and tilting means disposed forwardly of said sealing element and connected between a portion of said mounting element disposed above said horizontal axis and said engine.

43. In an inboard-outboard drive unit for a boat having an inboard engine and an apertured transom, the engine including an engine drive shaft extending rearwardly toward and aligned with the transom aperture and having a rearward end; said drive unit comprising an upright propeller leg including a lower housing portion disposed aft of said transom and an upper housing portion jointed thereto and partially disposed aft of said transom, said upper housing portion comprising a neck extending forwardly through said transom aperture, means pivotally mounting said neck to said boat for tilting of said leg about a generally horizontal tilt axis and for steering about a steering axis normal to and intersecting said tilt axis and establishing at such intersection a working center of said mounting means, a flexible watertight sealing element disposed rearwardly of said mounting means sealed to said neck outwardly therearound and extending outwardly from said neck and sealed to said transom around said aperture therein, said mounting means including means for fixing one of said axes with respect to the boat, a forwardly extending driven shaft disposed in said upper housing portion and having a forward end disposed rearwardly of said rearward end of said drive shaft, universal joint means drivingly connected between said forward end of said driven shaft and said rearward end of said drive shaft, said universal joint means having a working center substantially coincident with said working center of said mounting means, a propeller being carried by said lower housing portion, an upright intermediate shaft being disposed in said leg having an upper end portion in said upper housing portion and a lower end portion in said lower housing portion, said driven shaft having a rearward end portion in said upper housing portion, the axes of said driven shaft and said intermediate shaft intersecting at a ninety-degree angle, bevel gears in said upper housing portion connecting said last mentioned shafts including a first gear wheel on said upper end portion of said intermediate shaft and a second meshing gear wheel on said rearward end portion of said driven shaft, and a water impeller disposed rearwardly of said second gear wheel and above said first gear wheel, said impeller being axially aligned with one of said last mentioned shafts and drivingly connected thereto.

44. The combination according to claim 43 wherein said lower housing portion has a leading edge provided with a water inlet portion, wherein a pump housing encloses said impeller, and wherein said housing portions have water passageways therein constituting a supply conduit from said inlet port into said pump housing.

45. The combination according to claim 44 wherein a trim tab is carried by said lower housing portion disposed rearwardly of said propeller and in the slip stream therefrom and said tab is provided with a second water inlet port in said slip stream, at least one of said housing portions having a passageway therein which is connected to said second water inlet port and which has a connection with said supply conduit, said connection being located adjacent said leading edge and being disposed below the external water level when said leg is in its tilted position.

46. In an inboard-outboard drive unit for a boat having an inboard engine and an apertured transom, the engine including an engine drive shaft extending rearwardly toward and aligned with the transom aperture and having a rearward end; said drive unit comprising an upright propeller leg including a lower housing portion disposed aft of said transom and an upper housing portion joined thereto and partially disposed aft of said transom, said upper housing portion comprising a neck extending forwardly through said transom aperture, means pivotally mounting said neck to said boat for tilting of said leg about a generally horizontal tilt axis and for steering about a steering axis normal to and intersecting said tilt axis and establishing at such intersection a working center of said mounting means, a flexible watertight sealing element disposed rearwardly of said mounting means sealed to said neck outwardly therearound and extending outwardly from said neck and sealed to said transom around said aperture therein, said mounting means including means for fixing one of said axes with respect to the boat, a forwardly extending driven shaft disposed in said upper housing portion and having a forward end disposed rearwardly of said rearward end of said drive shaft, universal joint means drivingly connected between said forward end of said driven shaft and said rearward end of said drive shaft, said universal joint means having a working center substantially coincident with said working center of said mounting means, said leg further including an intermediate housing portion, said upper and lower housing portions each being joined to said intermediate portion.

47. The combination according to claim 46 wherein readily detachable means are provided for joining said upper and lower housing portions to said intermediate housing portion.

48. In an inboard-outboard drive unit for a boat having an apertured transom, an upper propeller leg housing portion comprising a first gear housing portion adapted to be disposed rearwardly of said transom and an integral forwardly extending neck portion adapted to extend therefrom through the aperture in said transom, an inboard engine support means connecting said neck portion to said engine for pivoting of said neck portion on a transverse horizontal axis, means inboard of said transom for connecting said support means to said boat, an upright intermediate shaft section journalled in said first gear housing portion and having a splined lower end portion, said first gear housing portion terminating downwardly in an attachable end adjacent said splined lower end portion, an input shaft journalled in said first gear housing portion, gear means in said first gear housing portion connecting said input shaft to said intermediate shaft section, said input shaft extending forwardly from said gear means into said neck portion, said engine having a rearwardly extending drive shaft, universal joint means connected between said drive and input shafts, said aperture being proportioned to pass said gear housing first portion therethrough including said intermediate shaft section, a second propeller leg housing portion having an upper attachable portion conforming to said attachable end, a second intermediate shaft section journalled in said second housing portion, coupling means for coupling said second shaft section to said splined lower end portion, and means for attaching said second housing portion to said upper propeller leg housing portion with its said upper attachable portion engaged with said attachable end of said first gear housing portion, said aperture being proportioned to pass said gear housing first portion and said second propeller leg housing portion therethrough including said intermediate shaft section and said second intermediate shaft section, said second propeller leg housing portion terminating downwardly in a second attachable end adjacent said coupling means, a third propeller leg housing portion having a second upper attachable portion conforming to said second attachable end, said third housing portion having a third intermediate shaft section journalled therein and splinedly connected adjacent its upper end to said coupling means, a propeller rotatably mounted on the lower end of said third housing portion, and means for driving said propeller coupled to the lower end of said third intermediate shaft section.

* * * * *